US009807494B2

(12) United States Patent
Yang

(10) Patent No.: US 9,807,494 B2
(45) Date of Patent: Oct. 31, 2017

(54) IN-EAR EARPHONE

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 15/149,188

(22) Filed: May 9, 2016

(65) Prior Publication Data

US 2017/0272853 A1 Sep. 21, 2017

(30) Foreign Application Priority Data

Mar. 21, 2016 (TW) ..... 105108625 A

(51) Int. Cl.
*H04R 1/10* (2006.01)

(52) U.S. Cl.
CPC ..... *H04R 1/1066* (2013.01); *H04R 1/1016* (2013.01)

(58) Field of Classification Search
CPC ..... H04R 1/1066; H04R 1/1016; H04S 7/304
USPC ..... 2/209; 181/129; 381/58, 71.6, 74, 380; 455/41.1, 569.1; 715/328, 728; 700/98
See application file for complete search history.

(56) References Cited

U.S. PATENT DOCUMENTS 6,412,593 B1 * 7/2002 Jones ..... H04R 1/1008 181/129
8,311,259 B2 * 11/2012 Pinter ..... H04R 1/1075 381/322
9,467,761 B2 * 10/2016 Grinker ..... H04R 1/1016
2006/0073787 A1 * 4/2006 Lair ..... H04M 1/6066 455/41.1
2008/0019554 A1 * 1/2008 Krywko ..... H04R 1/1058 381/380
2008/0037817 A1 * 2/2008 Ewert ..... H04R 1/1033 381/380
2009/0202098 A1 * 8/2009 Chan ..... H04R 1/1066 381/380
2009/0214071 A1 * 8/2009 Axelsson ..... H04R 1/1016 381/380
2010/0111348 A1 * 5/2010 Tsao ..... H04R 1/1016 381/380

(Continued)

FOREIGN PATENT DOCUMENTS

CN 102300138 4/2014
JP 2011151793 8/2011

(Continued)

OTHER PUBLICATIONS

"Office Action of Taiwan Counterpart Application", dated Mar. 29, 2017, p. 1-p. 4, in which the listed reference was cited.

(Continued)

*Primary Examiner* — Gerald Gauthier
(74) *Attorney, Agent, or Firm* — JCIPRNET

(57) ABSTRACT

An in-ear earphone including a housing, a speaker unit and an earpad is provided. The housing has a tube portion. The speaker unit is disposed inside the tube portion. The earpad has a connecting portion and a wrapping portion connected to the connecting portion. The connecting portion is assembled to an audio outlet end of the tube portion. The connecting portion and the speaker unit are surrounded and wrapped by the wrapping portion. Only the tube portion exists between an annular sidewall of the speaker unit and the wrapping portion.

10 Claims, 3 Drawing Sheets

(56) References Cited

U.S. PATENT DOCUMENTS

2011/0034218 A1* 2/2011 Sung ..... H04R 1/2842 455/569.1
2011/0051981 A1* 3/2011 Lehdorfer ..... H04R 1/1075 381/380
2011/0170730 A1* 7/2011 Zhu ..... H04R 25/00 381/380
2013/0315410 A1* 11/2013 Annunziato ..... H04R 1/1083 381/71.6
2013/0315411 A1* 11/2013 Annunziato ..... G10K 11/16 381/71.6
2013/0339859 A1* 12/2013 Hardi ..... G06F 3/016 715/728
2013/0343565 A1* 12/2013 Ridler ..... H04R 1/1058 381/74
2014/0093088 A1* 4/2014 Tachibana ..... H04R 1/1041 381/58
2014/0259287 A1* 9/2014 Waters ..... A61F 11/14 2/209
2015/0030173 A1* 1/2015 Foudhaili ..... H04R 1/1083 381/71.6
2015/0249879 A1* 9/2015 Matsuo ..... H04R 1/1016 381/380
2015/0382123 A1* 12/2015 Jobani ..... H04R 1/1016 700/98
2016/0050477 A1* 2/2016 Ushakov ..... H04R 1/1016 381/380
2016/0050483 A1* 2/2016 Kulavik ..... H04R 1/1041 381/380
2016/0094904 A1* 3/2016 Yuen ..... H04R 1/1016 381/380
2016/0269849 A1* 9/2016 Riggs ..... H04S 7/304

FOREIGN PATENT DOCUMENTS

JP 2012169952 9/2012
JP U3188830 2/2014

OTHER PUBLICATIONS

"Office Action of Japan Counterpart Application," dated Jul. 11, 2017, p. 1-p. 3, in which the listed references were cited.

* cited by examiner

IN-EAR EARPHONE

CROSS REFERENCE TO RELATED APPLICATION

This application claims the priority benefits of Taiwan application serial no. 105108625, filed on Mar. 21, 2016. The entirety of the above-mentioned patent application is hereby incorporated by reference herein and made a part of specification.

BACKGROUND OF THE INVENTION

Field of the Invention

The invention relates to an earphone, and specifically relates to an in-ear earphone.

Description of Related Art

Along with the continuous improvement of technology, all of electronic products have been developed with a tendency to become lighter and more miniaturized, and the electronic products like smartphone, tablet computer, or notebook, etc., have become indispensable in daily life of human beings. For each of those aforementioned electronic products, in order to allow a user/listener to listen to the audio information provided by the electronic product without disturbing the other people around, an earphone has become a necessary accessory to the electronic product. Moreover, the earphone also provides a better audio transmission to the listener so that the listener can clearly hear and understand the content of the audio information, and especially, unlike the an unclear audio transmission through the air, the audio transmission of the earphone is not be affected while the listener is moving, such as exercising, driving, engaging in intense movements or being in a noisy environment.

In recent years, the size of the speaker unit used for generating sound inside the earphone becomes smaller and smaller, so the speaker unit that is used to be located at the auricular region of the external part of the ear canal is inserted into the narrow ear canal. As a result, the earphone becomes light and handy, and the power consumption may also be reduced. On the other hand, in order to prevent the stiff housing of the earphone from causing discomfort in the ear canal, the outside of the housing of the current earphone is sheathed with a soft earpad. However, as shown in FIG. 1, currently, the outside of a tube portion 12 extending into the ear canal of the housing 10 is sheathed with an earpad 22. When the earpad 22 and the tube portion 12 are inserted into the ear canal together, a portion used for sheathing the tube portion 12 and the portion used for contacting the ear canal wall of the earpad 22 are clamped between the ear canal wall and the tube portion 12. With regard to the narrow ear canal, the thickness of the two superimposed portions of the earpad 22 may cause a substantial pressure, such that the user may have an oppressive feeling after wearing the earphone. Otherwise, the portion used for sheathing the tube portion 12 of the earpad 22 is easily loosened because of material aging.

SUMMARY OF THE INVENTION

The invention provides an in-ear earphone having an improved earpad design to prevent an oppressive feeling from generating in the ear canal.

An in-ear earphone of the invention includes a housing, a speaker unit, and an earpad. The housing has a tube portion. The speaker unit is disposed inside the tube portion. The earpad has a connecting portion and a wrapping portion connected to the connecting portion. The connecting portion is assembled to an audio outlet end of the tube portion, and the connecting portion and the speaker unit are surrounded and wrapped by the wrapping portion. Only the tube portion exists between an annular sidewall of the speaker unit and the wrapping portion.

In one embodiment of the invention, the diameter of the speaker unit is smaller than or equal to 6 mm.

In one embodiment of the invention, the maximum outer diameter of the tube portion is smaller than or equal to 8 mm.

In one embodiment of the invention, the connecting portion includes a snap ring and a soft portion, the snap ring is interlocked with the audio outlet end, and the soft portion and the wrapping portion are made of the same material and integrally formed.

In one embodiment of the present invention, contact surfaces of the snap ring and the soft portion are non-planar.

In one embodiment of the present invention, the snap ring has a protruding portion extending into the soft portion.

In one embodiment of the present invention, the material of the snap ring includes polyamide and glass fiber, and the material of the soft portion is silicone.

In one embodiment of the present invention, an inner wall of the audio outlet end has a plurality of bumps, the snap ring is interlocked with the bumps, and the bumps are partially trapped in the soft portion.

In one embodiment of the present invention, the number of the bumps is three, and the bumps are equidistantly distributed on the inner wall.

In one embodiment of the present invention, the material of the tube portion includes polychloroprene (PC) and acrylonitrile butadiene styrene (ABS).

Based on the above, in the in-ear earphone of the invention, the housing of the tube portion is not wrapped by the earpad, so as to reduce the overall size and to reduce the uncomfortable feeling generated by the oppression of the ear canal.

In order to make the aforementioned and other features and advantages of the invention more comprehensible, embodiments accompanying figures are described in detail belows.

DESCRIPTION OF THE EMBODIMENTS

Figure 1:
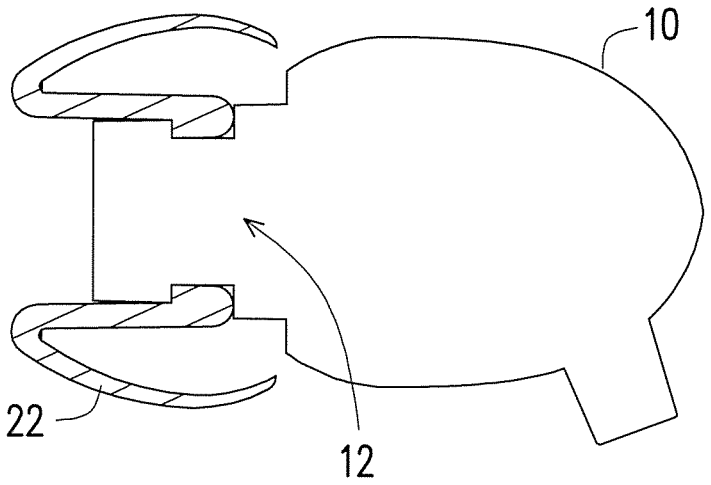
FIG. 1 (RELATED ART)
FIG. 1 is a cross-sectional schematic view of a conventional earphone.
Figure 2:
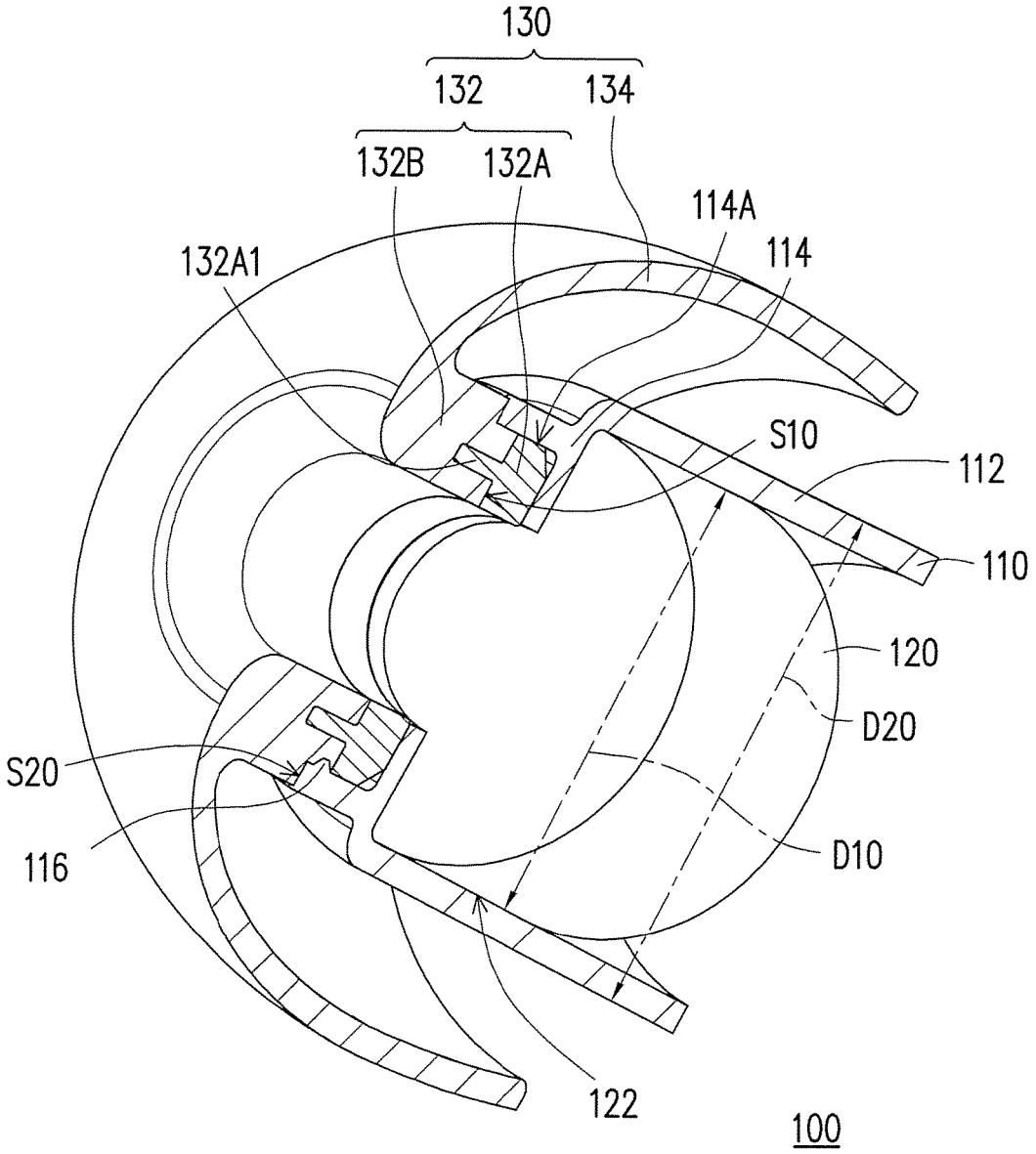
FIG. 2 is a partially cut perspective view of an in-ear earphone according to one embodiment of the invention.

FIG. 2 is a partially cut perspective view of an in-ear earphone according to one embodiment of the invention. Referring to FIG. 2, an in-ear earphone 100 of the present embodiment includes a housing 110, a speaker unit 120, and an earpad 130. The housing 110 has a tube portion 112. The speaker unit 120 is disposed inside the tube portion 112. The reason why the in-ear earphone 100 of the present embodiment is called "in-ear" is that the tube portion 112 of the in-ear earphone 100 may be placed into the ear canal from the auricle (the external ear), and the dead end of the ear canal is the eardrum, so the speaker unit 120 may be penetrated into the ear canal and approaches the eardrum. When the in-ear earphone 100 is wore on the ear of the user and is penetrated into the ear canal, an audio outlet end 114 of the tube portion 112 faces and approaches the eardrum of the ear, the sound generated by the speaker unit 120 may be received by the eardrum in an extremely low loss way, and the speaker unit 120 can be driven with low power.

The earpad 130 has a connecting portion 132 and a wrapping portion 134 connected to the connecting portion 132. The connecting portion 132 is assembled to the audio outlet end 114 of the tube portion 112. The connecting portion 132 and the speaker unit 120 are surrounded and wrapped by the wrapping portion 134. In the present embodiment, both the connecting portion 132 and the wrapping portion 134 have shapes similar to a tubular shape, and the connecting portion 132 and the wrapping portion 134 are connected to each other at one side. Because the tubular diameter of the connecting portion 132 is smaller than the tubular diameter of the wrapping portion 134, so the connecting portion 132 is located inside the wrapping portion 134. Otherwise, the wrapping portion 134 surrounds and wraps a portion of the tube portion 112, and the speaker unit 120 is located inside that portion of the tube portion 112, so the speaker unit 120 is also located inside the wrapping portion 134.

It is noteworthy that only the tube portion 112 exists between an annular sidewall 122 of the speaker unit 120 and the wrapping portion 134. In other words, there is only the wrapping portion 134 of the earpad 130 outside of the tube portion 112 where the speaker unit 120 exits, and the connecting portion 132 of the earpad 130 is not located outside of the tube portion 112 where the speaker unit 120 exits. Therefore, after the tube portion 112 of the in-ear earphone 100 is placed into the ear canal, only the tube portion 112 and the wrapping portion 134 of the earpad 130 exist between the speaker unit 120 and the ear canal. In comparison with the conventional earphone, the portion used for connecting the tube portion 112 of the earpad 130 does not cause an increase in size of the in-ear earphone 100 located inside the ear canal, so as to help improve the situation that the ear canal may be oppressed to generate an uncomfortable feeling.

In the present embodiment, a diameter D10 of the speaker unit 120 is, for example, smaller than or equal to 6 mm, and a maximum outer diameter D20 of the tube portion 112 is, for example, smaller than or equal to 8 mm. The average diameter of the ear canal of human is greater than 8 mm, so the above-mention size selection makes the in-ear earphone 100 suitable for most people to use.

In addition, the connecting portion 132 of the present embodiment includes, for example, a snap ring 132A and a soft portion 132B. The snap ring 132A is interlocked with the audio outlet end 114. The soft portion 132B and the wrapping portion 134 are made of the same material and integrally formed. For example, after the snap ring 132A is completely manufactured, the snap ring 132A is placed in a thermoforming equipment, and the insert molding technique is adopted to form the soft portion 132B and the wrapping portion 134 at once, so the soft portion 132B and snap ring 132A are tightly bonded and are difficult to be separated. The material with great rigidity is selected to be the material of the snap ring 132A, so the snap ring 132A and the audio outlet end 114 are tightly interlocked to avoid being loosened. When designing the interlocking force of the snap ring 132A and the audio outlet end 114, changing the size of the snap ring 132A may be used to determine the interlocking tightness.

In order to strengthen the bonding tightness of the soft portion 132B and the snap ring 132A, the contact surfaces S10 of the snap ring 132A and the soft portion 132B may be designed as non-planar surfaces, that is to say, the contacting area is increased so that the bonding strength is increased. For example, the snap ring 132A has a protruding portion 132A1 extending into the soft portion 132B. The material of the snap ring 132A of the present embodiment is a mixture of polyamide and glass fiber as an example, wherein glass fiber accounts for 30% of the mixture, for example. A high temperature resistant material may be selected to be the material of the snap ring 132A, so as to prevent the snap ring 132A from being deformed because of high temperature in the insert molding process. The material of the soft portion 132B is silicone as an example. The material of the tube portion 112 of the housing 110 in the present embodiment is a mixture of polychloroprene and acrylonitrile butadiene styrene as an example, wherein polychloroprene accounts for 30% of the mixture.

Figure 3:
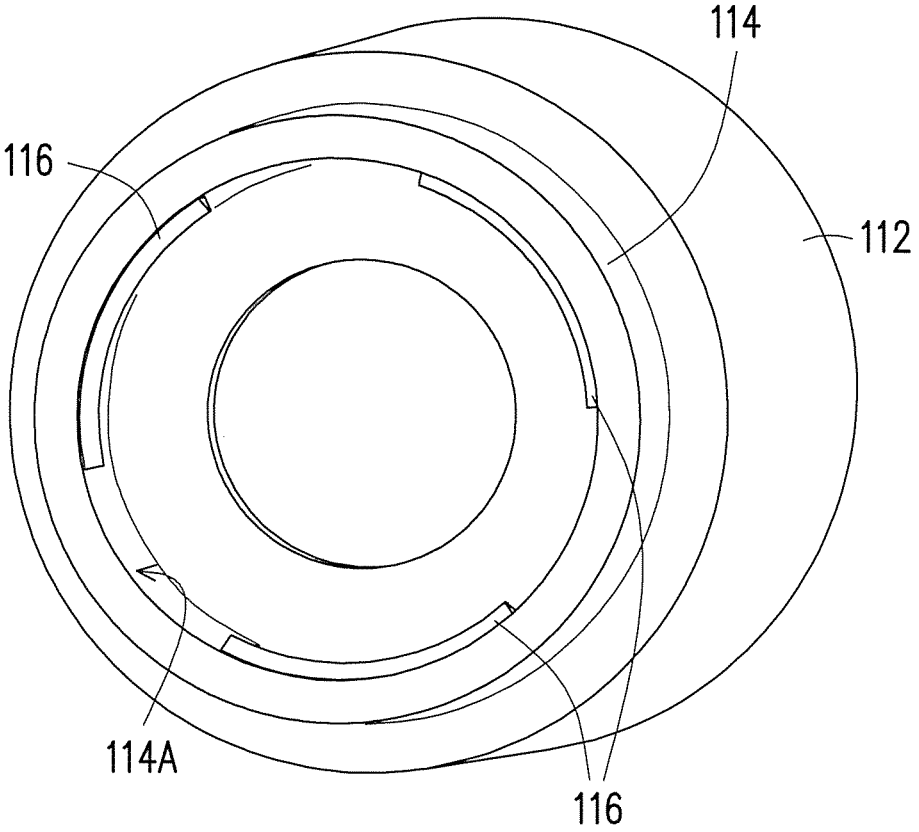
FIG. 3 is a perspective view of a tube portion of a housing of the in-ear earphone in FIG. 2.

In the present embodiment, an inner wall 114A of the audio outlet end 114 has a plurality of bumps 116, the snap ring 132A is interlocked with the bumps 116. Because the rigidities of the snap ring 132A and the bumps 116 are similar, the interlocking effect is definitely generated. After interlocking, the bumps 116 are partially trapped in the soft portion 132B. The outer diameter of the soft portion 132B may be slightly larger than the inner diameter of the inner wall 114A in order to generate a sealing effect between the soft portion 132B and the inner wall 114A, so as to enhance the sound quality. In a different way, the sealing effect may be achieved by the tight contact between end surfaces S20 of the soft portion 132B and the audio outlet end 114. FIG. 3 is a perspective view of the tube portion of the housing of the in-ear earphone in FIG. 2. Referring to FIG. 3, the number of the bumps 116 in the present embodiment is three as an example, and the three bumps 116 are equidistantly distributed on the inner wall 114A.

In summary, in the in-ear earphone of the invention, only the housing and the tube portion exist between the speaker unit and the wrapping portion of the earpad, the wrapping portion of the earpad and the connecting portion are not overlapped between the housing and the ear canal. Therefore, the situation that an oppressive feeling is generated in the ear canal by the earphone is improved.

Although the invention has been disclosed with reference to the aforesaid embodiments, they are not intended to limit the invention. It will be apparent to one of ordinary skill in the art that modifications and variations to the described embodiments may be made without departing from the spirit and the scope of the invention. Accordingly, the scope of the invention will be defined by the attached claims and not by the above detailed descriptions.

What is claimed is:

1. An in-ear earphone, comprising:

a housing, having a tube portion;

a speaker unit, disposed inside the tube portion; and an earpad, having a connecting portion and a wrapping portion connected to the connecting portion, wherein the connecting portion is assembled to an audio outlet end of the tube portion, the connecting portion and the speaker unit are surrounded and wrapped by the wrapping portion, and only the tube portion exists between an annular sidewall of the speaker unit and the wrapping portion.

2. The in-ear earphone as recited in claim 1, wherein a diameter of the speaker unit is smaller than or equal to 6 mm.

3. The in-ear earphone as recited in claim 1, wherein a maximum outer diameter of the tube portion is smaller than or equal to 8 mm.

4. The in-ear earphone as recited in claim 1, wherein the connecting portion comprises a snap ring and a soft portion, the snap ring is interlocked with the audio outlet end, and the soft portion and the wrapping portion are made of a same material and integrally formed.

5. The in-ear earphone as recited in claim 4, wherein contact surfaces of the snap ring and the soft portion are non-planar.

6. The in-ear earphone as recited in claim 5, wherein the snap ring has a protruding portion extending into the soft portion.

7. The in-ear earphone as recited in claim 4, wherein a material of the snap ring comprises polyamide and glass fiber, a material of the soft portion is silicone.

8. The in-ear earphone as recited in claim 4, wherein an inner wall of the audio outlet end has a plurality of bumps, the snap ring is interlocked with the bumps, and the bumps are partially trapped in the soft portion.

9. The in-ear earphone as recited in claim 8, wherein a number of the bumps is three, and the bumps are equidistantly distributed on the inner wall.

10. The in-ear earphone as recited in claim 1, wherein a material of the tube portion comprises polychloroprene and acrylonitrile butadiene styrene.

* * * * *